United States Patent [19]

Vann et al.

[11] 4,436,154

[45] Mar. 13, 1984

[54] METHOD FOR CONTROLLING SUBSURFACE BLOWOUT

[75] Inventors: Roy R. Vann, Houston; Flint R. George, Katy, both of Tex.

[73] Assignee: Geo Vann, Inc., Houston, Tex.

[21] Appl. No.: 236,867

[22] Filed: Feb. 23, 1981

[51] Int. Cl.[3] ..... E21B 43/12

[52] U.S. Cl. ..... 166/281; 166/271; 166/286; 166/364

[58] Field of Search ..... 166/50, 52, 63, 271, 166/277, 281, 285, 286, 289, 297, 298, 363, 364; 175/4.51, 45, 61

[56] References Cited

U.S. PATENT DOCUMENTS

| | | | |
|---|---|---|---|
| 2,813,584 | 11/1957 | Teplitz | 166/299 |
| 3,003,557 | 10/1961 | Huitt et al. | 166/271 |
| 3,282,355 | 11/1966 | Henderson | 175/61 |
| 3,771,601 | 11/1973 | Garrett | 166/297 |
| 4,133,383 | 1/1979 | Ely | 166/285 |
| 4,193,460 | 3/1980 | Gilbert | 175/4.51 |
| 4,224,989 | 9/1980 | Blount | 166/271 |
| 4,279,301 | 7/1981 | Williams | 166/281 |

*Primary Examiner*—Stephen J. Novosad

*Assistant Examiner*—William P. Neuder

[57] ABSTRACT

A method of recompleting or controlling the flow of a formation which is inaccessible through the original wellbore and which is losing valuable hydrocarbons to another formation. A second borehole is formed in close proximity to the first wellbore, and at least the bottom end of the new borehole is slanted until it penetrates the hydrocarbon bearing formation within shooting distance of the bottom end of the first wellbore. A large casing gun is run downhole through the new borehole. All of the shaped charges of the gun are oriented in the same direction. Indexing means are included by which all of the shaped charges of the gun are oriented to fire towards the casing of the first wellbore. After the gun is discharged, cement is pumped down the borehole, through the tunnels formed by the shaped charges, and into the perforations of the wellbore casing, thereby killing the flow of hydrocarbons from the damaged wellbore. The two wells may be abandoned, or a whipstock can be employed to form a third lower end of still another borehole branched off the second borehole which penetrates the high pressure lower production formation so that production can be established while salvaging the second one of the holes.

10 Claims, 5 Drawing Figures

METHOD FOR CONTROLLING SUBSURFACE BLOWOUT

BACKGROUND OF THE INVENTION

Some hydrocarbon production fields have boreholes which penetrate to various different depths, so that production from two or more different levels or geological formations may simultaneously occur. Some of these wells may be dual completed, whereupon production from two different zones are maintained separated from one another but are produced concurrently from the same wellbore. In this same oil field, there may be other boreholes which extend to only one of the multiple production levels.

Sometimes difficulties are experienced with dual completion wells. For example, in the case of a dual completed well having an extremely high pressure lower formation, the lower packer has been known to fail, whereupon high pressure hydrocarbons from the lower payzone rush uphole and commence entering the upper payzone. This sudden release of high pressure hydrocarbons can shock the upper packer with sufficient force to cause the packer to fail. The upper packer loses control of the well, and under extreme conditions erosion of the upper perforated zone commences cavitating the formations.

The above failure may continue to progress until it is impossible to shut-in the well using conventional methods. Drilling mud cannot be pumped down the borehole in order to kill the well because of the damaged area surrounding the upper formation. Until the well is killed, valuable hydrocarbons from the lower zone are lost into the upper zone.

Many high pressure wells extend through thousands of feet of salt formation. It is possible for the salt formation to shift laterally with sufficient shear force to sever the casing and production tubing, whereupon the high pressure fluid is uncontrollably released into the salt formation.

Earthquakes and other disturbances brought about by abnormal geological phenomena can have similar devastating effects and cause below surface blowout of oil wells.

Method and apparatus by which a subsurface well blowout, such as described above, can be brought under control is the subject of the present invention.

SUMMARY OF THE INVENTION

This invention relates to method and apparatus for bringing a well having a subsurface blowout under control, wherein a high pressure lower payzone has erupted into an upper formation or zone. A second borehole is formed in spaced relationship to the blown-out wellbore. The lower end of the new borehole is slanted towards the lower end of the damaged wellbore so that the lower end of the new borehole is brought within shooting range of the casing of the first wellbore adjacent the high pressure lower production zone. A gun having a plurality of enormous shaped charges is run downhole within the new borehole until the perforating gun is positioned adjacent the old casing in proximity of the high pressure lower production zone. The gun is oriented to cause all of the shaped charges thereof to be directed radially away from the new hole and towards the casing near the lower zone of the damaged wellbore. The perforating gun is fired, thereby communicating the lower end of the new borehole with the lower end of the damaged wellbore.

Cement is pumped downhole through the new borehole and forced into the lower perforated end of the old wellbore, and back up the wellbore, until flow from the well is killed.

After the well has been brought under control, another slanted lower end of the borehole can be formed through the lower payzone and the new slanted portion of the borehole completed, thereby regaining production in a safe manner which does not disturb the cement job.

Accordingly, a primary object of the present invention is the provision of method and apparatus by which uncontrolled flow from a lower formation uphole towards an upper formation is brought under control.

Another object of the present invention is the provision of method and apparatus by which uncontrolled flow from a lower formation which is inaccessible through the original wellbore is brought under control and recompleted.

Still another object of the present invention is the provision of a method by which flow from a lower formation uphole towards the surface of the ground is brought under control.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
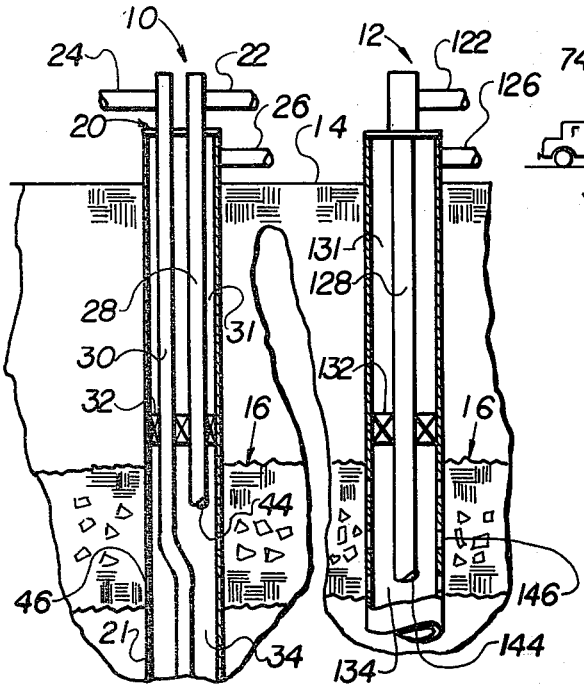
FIG. 1 is a schematic representation of wellbores penetrating the earth.

In FIG. 1 of the drawings, there is shown prior art spaced apart wellbores 10 and 12. The wellbore 10 is a dual completed well while the wellbore 12 extends downhole to only one production formation.

The wellbore 10 extends below the surface 14 of the ground, through an upper payzone 16, and through a lower high pressure payzone 18. A wellhead 20 is provided with the usual Christmas tree which is attached to the upper terminal end of a casing 21. The Christmas tree includes outlets 22, 24, and 26, respectively, connected to production tubing 28, production tubing 30, and upper casing annular area 31, respectively.

Packer 32 is a dual packer and isolates a central annulus 34 from the upper annulus 31. A lower annulus 36 underlies the lower packer 38. The casing is perforated at 40 so that hydrocarbons from the lower formation can flow through the perforations, into the lower annulus, into the inlet end 42 of tubing 30, and uphole to the outlet 24. Inlet 44 of tubing 28 likewise receives produced fluid which flows from formation 16, through the perforations 46, into annulus 34, into the inlet 44 of tubing 28, and to the Christmas tree where the production from the upper zone exits through outflow pipe 22.

The wellbore 12 includes a packer 132 which separates the casing annulus into upper annulus 131 and lower annulus 134. Production from formation 16 occurs through perforations 146, into the inlet end 144 of the production tubing 128, up the tubing, and to the Christmas tree where the flow exits at 122.

Figure 2:
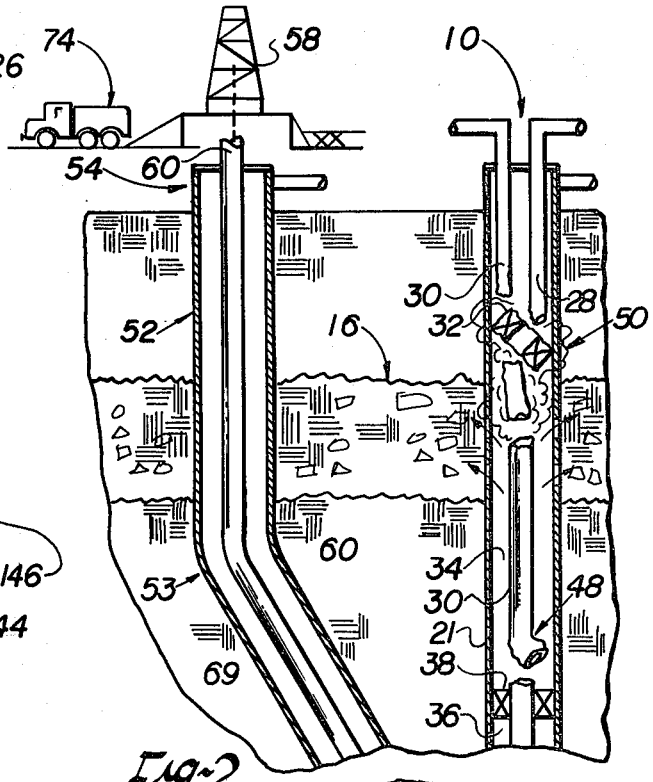
FIG. 2 is a cross-sectional view of wellbores formed into the ground, with some steps of the present invention being disclosed therewith.

In FIG. 2, it will be noted that a malfunction has occurred to wellbore 10, as indicated by the arrow at numeral 48, which was caused by tubing 30 becoming separated from packer 38 and accordingly, a tremendous surge of hydrocarbons from the lower high pressure formation rushed uphole and impacted against the dual packer 32. The force of the impact unseated the packer which was subsequently forced uphole along with thousands of feet of the tubing string and pieces of formation 16 and 18. An enormous flow of hydrocarbons continue to leave the lower formation and enter the upper formation, and therefore a considerable amount of production is lost from the lower high pressure reservoir until the wellbore 10 can be brought under control.

In accordance with the present invention, a new borehole 52 has been formed down through the formation 16, where the borehole is slanted at 53 and continues down towards the lower formation. The borehole is cased and provided with a suitable wellhead at 54 by which the well can subsequently be controlled when it becomes necessary to do so. The lower end 56 of the new borehole is placed in close proximity to the lower perforated zone of the wellbore casing. Drilling rig 58 preferably remains on location while carrying out the present invention. Drill pipe or production tubing 60 is connected to a large casing gun 62. All of the shaped charges 64 of the casing gun have been oriented in the same direction. A conventional type of orienting apparatus 66 is included in the tool string so that the shaped charges can be aligned radially away from the new borehole 52 and directed towards the lower marginal end of the damaged wellbore 10.

Figure 3:
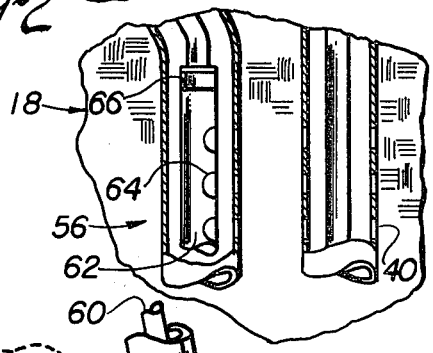
FIG. 3 is a fragmentary representation of part of the FIG. 2 disclosure which illustrates some of the features of the present invention.
Figure 3:
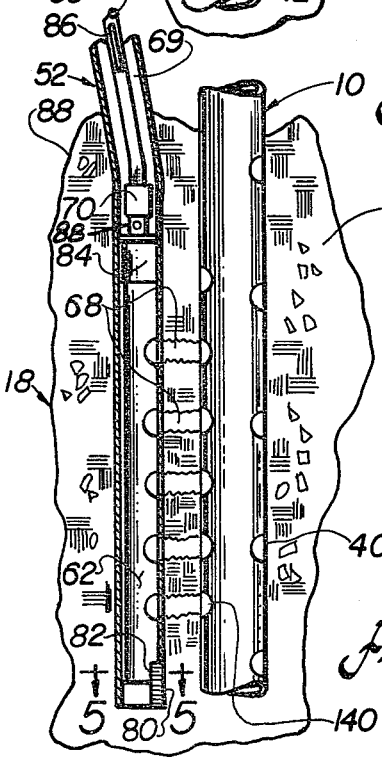

In FIG. 3, the shaped charges have been detonated, thereby forming tunnels 68 which communicate annulus 36 of the damaged wellbore with the annulus 69 of the new borehole. A releasable coupling 70, made in accordance with U.S. Pat. Nos. 3,966,236 and 4,066,282, is interposed between the tubing 60 and the jet gun.

Figure 4:
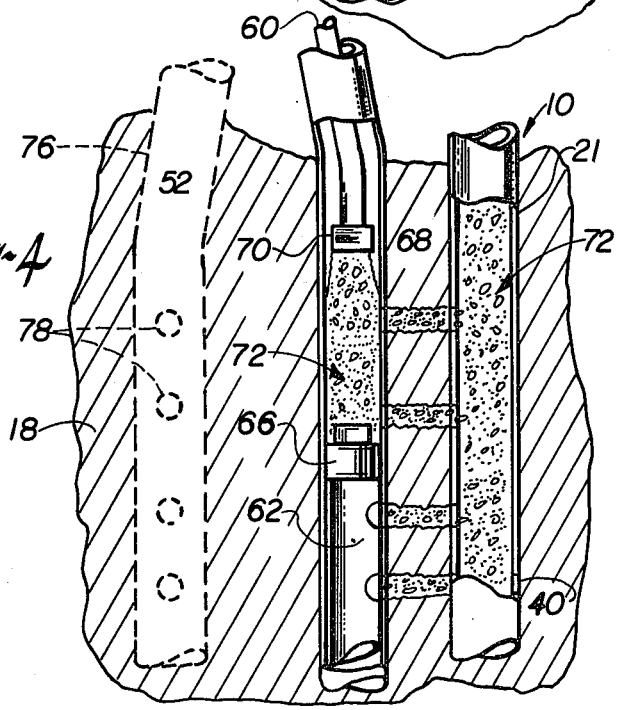
FIG. 4 is similar to FIG. 3 and shows additional steps of the present invention; and, FIG. 5 is a cross-sectional view taken along line 5—5 of FIG. 3.

As seen in FIG. 4, coupling 70 has been released leaving gun 62 and orienter 66 in the bottom of the wellbore, in accordance with the aforementioned patents, cement 72 has been forced down the tubing string 60, and squeezed through the tunnels and perforations 40 (see FIG. 2) 68 into the annulus 36 of the perforated casing of damaged wellbore 10. The cement is pumped into the wellbore 10 until the production is killed and no flow occurs from formation 18, uphole towards formation 16.

Numeral 74 indicates a cement truck, such as a Halliburton rig. The numeral 76 indicates a new slanted hole which has been deviated away from the second wellbore and first borehole. The new slant hole can subsquently be perforated at 78 using techniques set forth in U.S. Pat. No. 3,706,344 so that the newly formed borehole can replace the old damaged wellbore, thereby taking advantage of the existing facilities.

Figure 5:
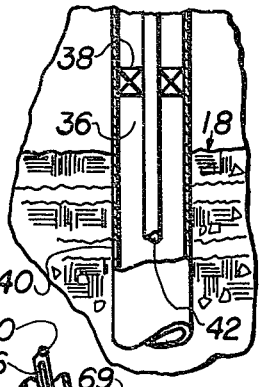
Figure 5:
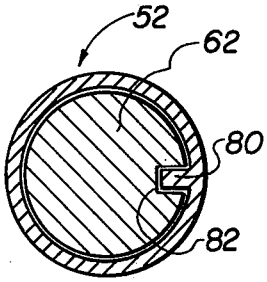

Referring once more to FIG. 3 and also to FIG. 5, it will be seen that there is a key 80 in the casing at the lower end of the new cased borehole, hence it is not necessary to include the apparatus 66 in FIG. 3. The keyed casing was oriented with a conventional orienting apparatus. The lower end of the gun housing is provided with a notch 82 made complementary to key 80, so that the gun can be manipulated by string 60 until the notch and key are brought into registry with one another, whereupon all of the shaped charges are directed radially away from the new hole and towards the lower end of the damaged wellbore.

The key 80 can be installed further uphole if desired so that the gun perforates an area of casing 10 which is located above the old perforated zone. The new perforations, in this instance, must penetrate the old casing of wellbore 10, unless the cement pump can develop sufficient pressure differential to tunnel across the intervening strata to the old perforations.

In FIG. 3, a bar 86 is circulated downhole to detonate gun firing head 84 in accordance with U.S. Pat. No. 3,706,344.

The shaped charges are e.g. 300 grams placed on 9 inch spacings along 100 feet of gun housing. The usual charge of prior art guns is 30 grams, so it is evident that an extremely large amount of energy will be released when the gun is actuated. The charge size is a whole order of magnitude larger than usual, such a large charge size, i.e., 100 grams or larger, may be called a super charge.

OPERATION

In operation, after all efforts for killing the wellbore 10 by conventional means has failed, the drilling rig 58 is moved onto location and a borehole 52 formed into the ground. The new borehole preferably is spudded in several hundred feet from the wellbore 10 to lessen the danger of fire and explosions. A whipstock is employed to slant the lower portion 53 of the borehole so that the lowermost end 56 arrives as close as possible to the loer end of the old casing 21.

A large casing gun 62 is mated with conventional orienting apparatus 66 and the entire package run downhole on either the drill string or any suitable tubing. All of the extremely large 300 gram shaped charges 64 are oriented radially away from borehole 52 and towards wellbore 10. The gun is detonated thereby forming passageways 68 which communicate the new borehole with the old wellbore.

Alternatively, it is advantageous to have previously provided the gun housing and lower end of the borehole casing with the illustrated coacting slot 80 and key 82, so that when the slot and key are brought into registry, the gun charges are properly oriented towards the old hole.

It is advantageous to communicate the two boreholes at the old perforated zone so that killing fluid, such as heavy drilling mud or cement, is pumped exteriorly of the old perforations. In many instances, it is advantageous to locate the perforating guns uphole of the perforated zone of the old casing so that the new perforations make entry above the payzone, and therefore cement can be pumped into the old casing at a location uphole of the original perforations.

In some instances where the borehole is placed several feet from the wellbore, the jet charge may tunnel to the casing but fail to penetrate the casing wall. In this instance, it is possible to circulate sufficient cement through the tunnels 68 and through the old perforations and into the cased wellbore. It is preferable, however, to place the lower end of the new borehole close enough to the perforated casing of the wellbore to enable penetration to occur. The term "shooting distance" is intended to include all of the above relationships of the gun and old wellbore.

Another advantage derived from the present concept is that the gun can be positioned downhole at a location where entry is made above the payzone, and the cement is pumped simultaneously with actuation of the perforating gun. This technique forces cement to flow through the tunnels concurrently with their formation, thereby enhancing communication between the two adjacent boreholes, and increasing the volume of cement conveyed into the damaged borehole per unit of time. Accordingly, the cement flows into the old wellbore and rapidly accumulates at a rate which enhances the action of killing the well and thereby permanently seals off the high pressure formation from the upper strata.

We claim:

1. In a formation having a cased wellbore extending thereto, wherein the wellbore is damaged and the formation is inaccessible therethrough, the method of reworking the formation comprising the steps of:

(1) forming a borehole which is arranged in spaced relationship to the wellbore; and, drilling the lower end of the borehole non-intersecting but within shooting range of the wellbore;

(2) orienting a plurality of shaped charges of a perforating gun to fire in the same direction;

(3) running the gun of step (2) downhole into the borehole at a location adjacent to the perforated casing of the wellbore; orienting the gun respective to the wellbore to position the shaped charges to fire radially away from the gun and form tunnels towards the perforated casing of the wellbore;

(4) firing the gun;

(5) pumping killing fluid down through the borehole, through the tunnels, and into the lower end of the wellbore, thereby isolating the formation from the upper wellbore; the killing fluid being pumped down the cased borehole simultaneously with the firing of the gun, with the killing fluid being maintained at a pressure which forces a flow path to be formed from the borehole into the perforated zone of the wellbore.

2. In a formation having a cased wellbore extending thereto, wherein the wellbore is damaged and the formation is inaccessible therethrough, the method of reworking the formation comprising the steps of:

(1) forming a borehole which is arranged in spaced relationship to the wellbore; and, drilling the lower end of the borehole non-intersecting but within shooting range of the wellbore;

(2) orienting a plurality of shaped charges of a perforating gun to fire in the same direction;

(3) running the gun of step (2) downhole into the borehole at a location adjacent to the perforated casing of the wellbore; orienting the gun respective to the wellbore to position the shaped charges to fire radially away from the gun and form tunnels towards the perforated casing of the wellbore;

(4) firing the gun;

(5) pumping killing fluid down through the borehole, through the borehole, through the tunnels, and into the lower end of the wellbore, thereby isolating the formation from the upper wellbore; wherein the gun is run into the borehole on a tubing string, and the killing fluid is cement which is pumped4imultaneously with the firing down the tubing string, said gun is released from said tubing string by a releasable coupling means.

3. Method of claim 2 wherein the tunnels are formed to extend from the borehole to new formed perforations at a location which is above the old perforations.

4. In a formation having a cased wellbore extending thereto, wherein the wellbore is damaged and the formation is inaccessible therethrough, the method of reworking the formation comprising the steps of:

(1) forming a borehole which is arranged in spaced relationship to wellbore; and, drilling the lower end of the borehole non-intersecting but within shooting range of the wellbore;

(2) orienting a plurality of shaped charges of a perforating gun to fire in the same direction;

(3) running the gun of step (2) downhole into the borehole at a location adjacent to the perforated casing of the wellbore; orienting the gun respective to the wellbore to position the shaped charges to fire radially away from the gun and form tunnels towards the perforated casing of the wellbore;

(4) firing the gun;

(5) pumping killing fluid down through the borehole, through the tunnels, and into the lower end of the wellbore, thereby isolating the formation from the upper wellbore; wherein the tunnels are formed to extend to the old perforations of the wellbore, so that the killing fluid is forced to flow from the borehole, through the tunnels, and into the wellbore at a rate which accumulates sufficient killing fluid to shut-in the wellbore from the formation; the killing fluid being pumped down the cased borehole simultaneously with the firing of the gun, with the killing fluid being maintained at a pressure which forces a flow path to be formed from the borehole into the perforated zone of the wellbore.

5. In a formation having a cased wellbore extending thereto, wherein the wellbore is damaged and the formation is inaccessible therethrough, the method of reworking the formation comprising the steps of:

(1) forming a borehole which is arranged in spaced relationship to the wellbore; and, drilling the lower end of the borehole within shooting range of the wellbore;

(2) orienting a plurality of shaped charges of a perforating gun to fire in the same direction;

(3) running the gun of step (2) downhole into the borehole at a location adjacent to the perforated casing of the wellbore; orienting the gun respective to the wellbore to position the shaped charges to fire radially away from the gun and form tunnels towards the perforated casing of the wellbore;

(4) firing the gun, (5) pumping killing fluid down through the borehole, through the tunnels, and into the lower end of the wellbore, thereby isolating the formation from the upper wellbore;

said tunnels being formed to extend from the borehole to new formed perforations at a location which is above the old perforations;

the killing fluid being pumped down the cased borehole simultaneously with the firing of the gun, with the killing fluid being maintained at a pressure which forces a flow path to be formed from the borehole into the perforated zone of the wellbore.

6. Method of claim 5 wherein the killing fluid is cement, and the lower end of the borehole is slanted to cause the borehole to be placed in shooting distance of the wellbore; the cement is left at the bottom of the borehole and producing via a borehole branch.

7. In a wellbore having a high pressure lower formation which is uncontrollably flowing uphole, the method of bringing the well under control, comprising the steps of:

(1) forming a borehole into the ground which everywhere is spaced from the wellbore and slanting the lower end of the borehole to place the lower marginal end of the borehole adjacent to a marginal length of the wellbore at a location where the wellbore penetrates the lower formation;

(2) running a perforating gun downhole within the borehole until the gun is located in close proximity to the wellbore and at an elevation which is in close proximity of said lower formation;

(3) orienting a multiplicity of charges for the gun to fire in like direction so that the charges penetrate from said borehole towards said wellbore;

(4) detonating the gun, thereby forming formation tunnels communicating the borehole with the borehole;

(5) pumping killing fluid down the borehole and into the wellbore simultaneously with the firing of the gun, thereby isolating the lower formation and preventing flow uphole therefrom.

8. The method of claim 7 wherein the charges of the gun are positioned adjacent to the perforated zone level of the wellbore, to thereby penetrate to the old casing perforations of the wellbore; and, cement is used as the killing fluid.

9. The method of claim 8 wherein the gun is located in the borehole above the old perforations of the wellbore so that entry is made into the wellbore at a location above the old perforated zone of the wellbore.

10. The method of claim 8 wherein the borehole is provided with a second slanted lower end which penetrates the lower formation at a location spaced from the first recited lower end of the borehole and wellbore, so that production from the borehole can be carried out up through the second slanted lower end after the cementing operation has been completed.

* * * * *